US010370786B2

(12) United States Patent
Kim

(10) Patent No.: US 10,370,786 B2
(45) Date of Patent: Aug. 6, 2019

(54) MATRIX FOR LETTERS OR PATTERNS ON FABRIC

(71) Applicant: Yong Chong Kim, Los Angeles, CA (US)

(72) Inventor: Yong Chong Kim, Los Angeles, CA (US)

( * ) Notice: Subject to any disclaimer, the term of this patent is extended or adjusted under 35 U.S.C. 154(b) by 56 days.

(21) Appl. No.: 15/610,985

(22) Filed: Jun. 1, 2017

(65) Prior Publication Data

US 2018/0263323 A1 Sep. 20, 2018

Related U.S. Application Data

(60) Provisional application No. 62/472,036, filed on Mar. 16, 2017.

(51) Int. Cl.

| | |
|---|---|
| ***D06C 23/00*** | (2006.01) |
| ***A41F 1/00*** | (2006.01) |
| ***A41F 1/02*** | (2006.01) |
| ***A41D 27/08*** | (2006.01) |
| *B44F 1/08* | (2006.01) |
| *B44C 1/28* | (2006.01) |

(52) U.S. Cl.

CPC ..... *D06C 23/00* (2013.01); *A41D 27/08* (2013.01); *A41F 1/004* (2013.01); *A41F 1/02* (2013.01); *B44C 1/28* (2013.01); *B44F 1/08* (2013.01)

(58) Field of Classification Search

CPC ..... D06C 23/00; A41D 27/08; B44C 1/28; G09B 23/04; A41F 1/04; A41C 1/00

See application file for complete search history.

(56) References Cited

U.S. PATENT DOCUMENTS 1,264,829 A * 4/1918 McConnell ..... A41F 1/04 450/108

2013/0326788 A1* 12/2013 Bell ..... A41C 1/00 2/113

* cited by examiner

*Primary Examiner* — Robert Sandy

(74) *Attorney, Agent, or Firm* — John K. Park; Park Law Firm

(57) ABSTRACT

A matrix for fabric includes engaging portions and decorating portions. The engaging portions are disposed over a surface area of the fabric. The decorating portions are installed at the engaging portions. The decorating portions form letters or patterns on the specific surface area of the fabric. The engaging portions may be aligned so as to form a lattice. Eyes of the lattice may be triangular, rectangular, or hexagonal. Each of the engaging portions may have a hole through the fabric. The engaging portions may include eyelets, each of which being fixed to the hole at an external perimeter of the eyelet.

6 Claims, 6 Drawing Sheets

Fig. 11
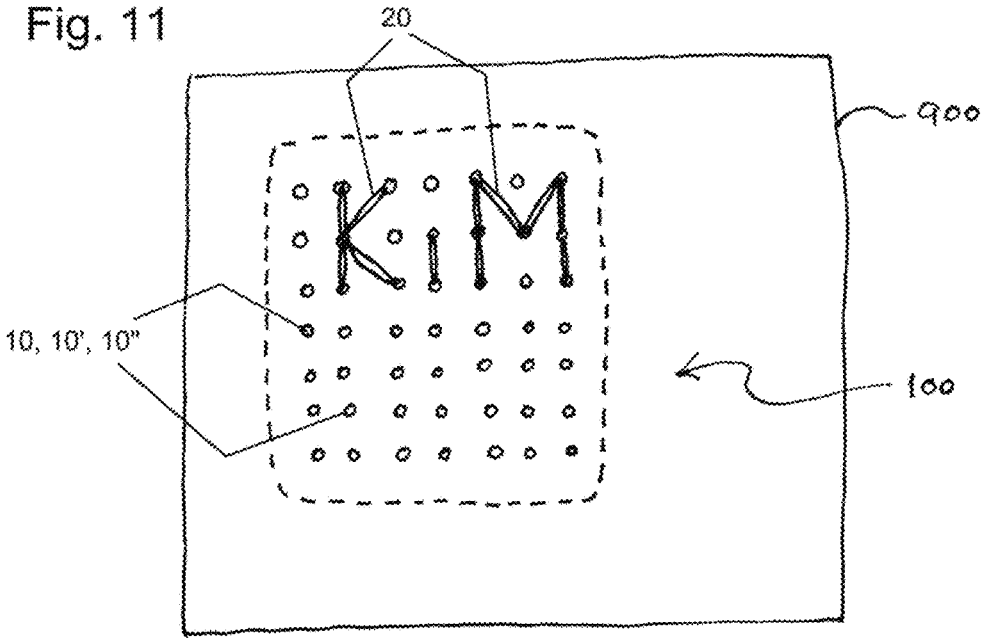
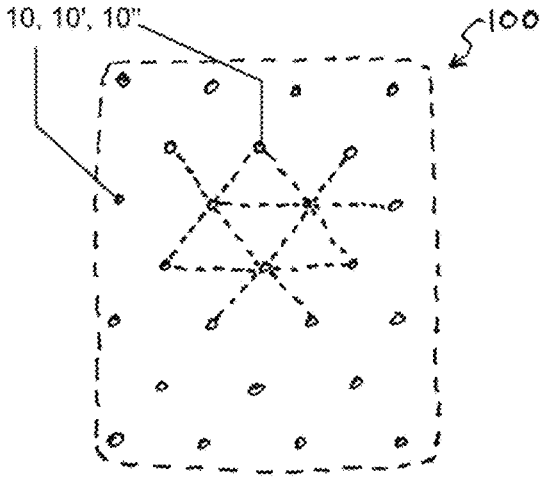
Fig. 12
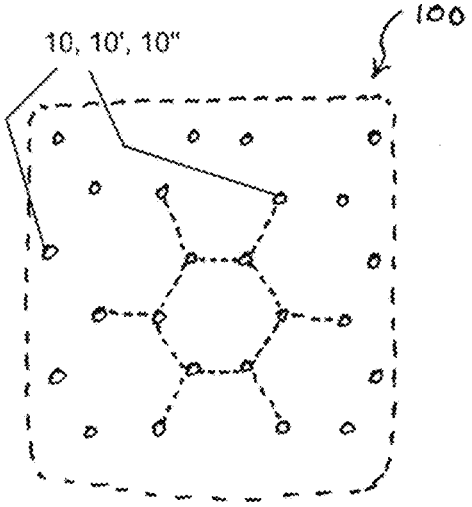
Fig. 13

Fig. 14
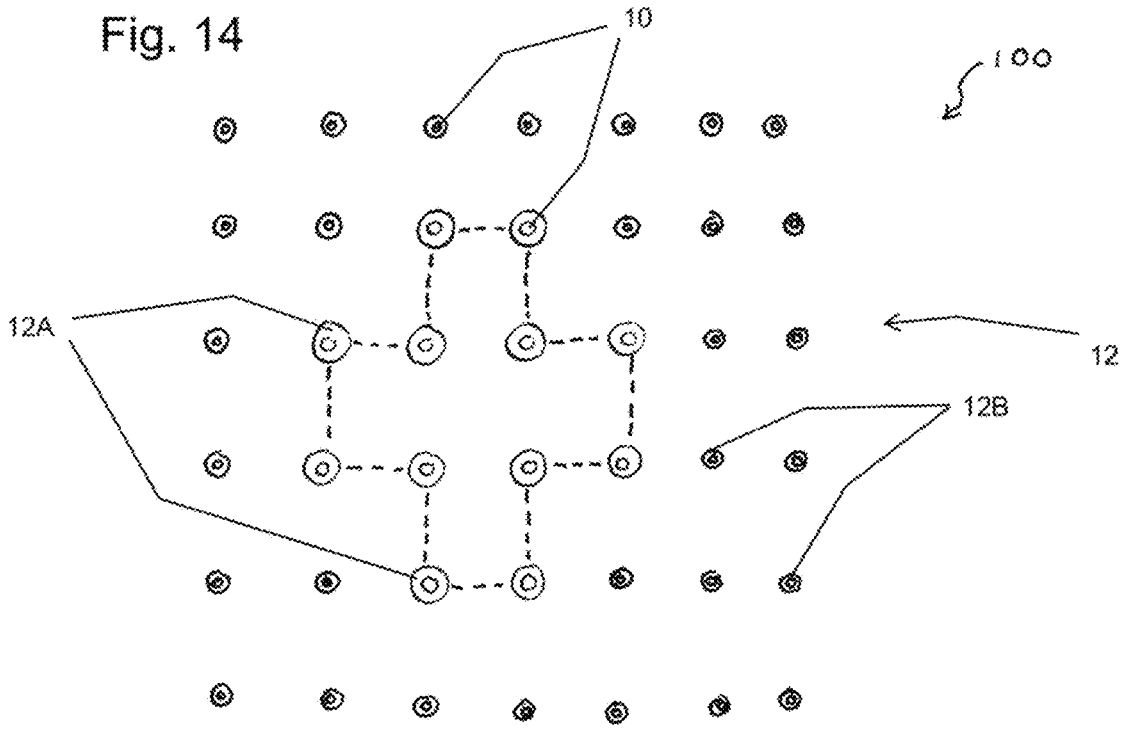
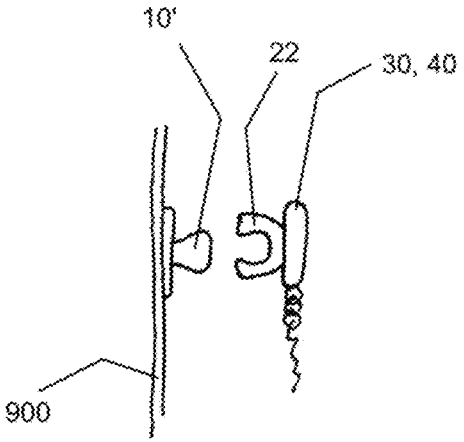
Fig. 15
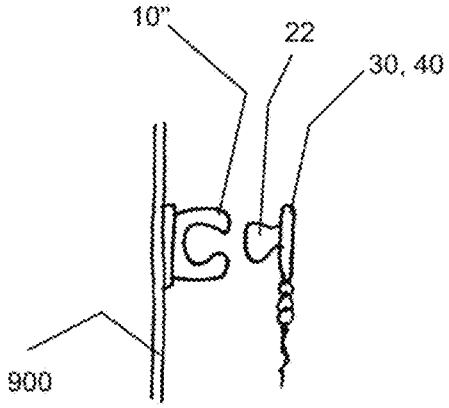
Fig. 16

MATRIX FOR LETTERS OR PATTERNS ON FABRIC

RELATED APPLICATION

This application is a Non-provisional Application of Provisional Application Ser. No. 62/472,036 for "Matrix for Letters or Patterns on Fabric" filed on 16 Mar. 2017.

BACKGROUND OF THE INVENTION

The present invention relates to a matrix for letters and patterns on fabric.

Sometimes, fabric or cloth needs to be decorated with letters or patterns.

SUMMARY OF THE INVENTION

The present invention contrives to solve the disadvantages of the prior art.

An aspect of the invention provides a matrix for fabric, and the matrix comprises a plurality of engaging portions and one or more decorating portions.

The plurality of engaging portions are disposed over a specific surface area of the fabric.

The one or more decorating portions are installed at one or more of the plurality of engaging portions.

The one or more decorating portions form letters or patterns on the specific surface area of the fabric.

The plurality of engaging portions may be aligned so as to form a lattice.

Eyes of the lattice may be triangular, rectangular, or hexagonal.

Each of the plurality of engaging portions may have a hole through the fabric.

The plurality of engaging portions may comprise eyelets, each of which being fixed to the hole at an external perimeter of the eyelet.

Each of the one or more decorating portions may comprise a string, and the string may be queued through or tied at some of the eyelets, so as to form the letter or pattern.

Some of the eyelets may have shape and color different from remaining eyelets, so as to facilitate to form the letter or pattern.

Each of the plurality of engaging portions may comprise a protruding thumbtack or a receding thumbtack.

Each of the one or more decorating portions comprises a counter-part of the protruding or receding thumbtack to be attached detachably to the protruding or receding thumbtack.

The each of the one or more decorating portions may further comprise a displaying button-top or hanging decoration, which is fixed to the counter-part.

Alternatively, each of the plurality of engaging portions may comprise a hook.

The hook may comprise a fixing portion configured to fix the hook to the fabric, a retaining portion configured to retain one of the one or more decorating portions, and a hooking portion provided between the fixing portion and the retaining portion and configured to hooking the one of the one or more decorating portions.

Each of the fixing portion and the retaining portion may have a shape of disc and the hooking portion has a shape of cylinder, and the diameter of the hooking portion may be smaller than the diameter of the fixing portion and the retaining portion with the hooking portion penetrating the fabric.

The hooking portion may extend substantially vertically from the fixing portion and the retaining portion may extend substantially horizontally from the hooking portion, forming a retaining gap surrounded by the hooking portion, the retaining portion, and the fixing portion.

Alternatively, each of the plurality of engaging portions may comprise magnet, and each of the one or more decorating portions may comprise material with magnetism.

One of the one or more decorating portions may comprise a button configured to be attached to one of the plurality of engaging portions, and the button may have a color, a letter, or a pattern.

One of the one or more decorating portions may comprise chains or strings.

The matrix may further comprise a lining or line clothes on the fabric behind the matrix, preventing a wearer's skin from being abraded by the matrix.

The advantages of the present invention are: (1) the matrix for letters and patterns on fabric according to the invention provides a simple structure for performing the purposes; and (2) the matrix for letters and patterns on fabric according to the invention provides a sturdy structure using a minimal number of components in order to achieve the above goals.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 11 is a perspective view showing a rectangular matrix for letters and patterns on fabric with letters according to still another embodiment of the invention;

FIG. 12 is a perspective view showing a triangular matrix for letters and patterns on fabric with letters according to still another embodiment of the invention;

FIG. 13 is a perspective view showing a hexagonal matrix for letters and patterns on fabric with letters according to still another embodiment of the invention;

FIG. 14 is a plan view showing a matrix installed with two kinds of eyelets with letters according to still another embodiment of the invention;

FIG. 15 is a side view showing a protruding thumbtack and a counter-part according to still another embodiment of the invention;

FIG. 16 is a side view showing a receding thumbtack and a counter-part according to still another embodiment of the invention;

DETAILED DESCRIPTION EMBODIMENTS OF THE INVENTION

Referring to the figures, the embodiments of the invention are described in detail.

Figure 1:
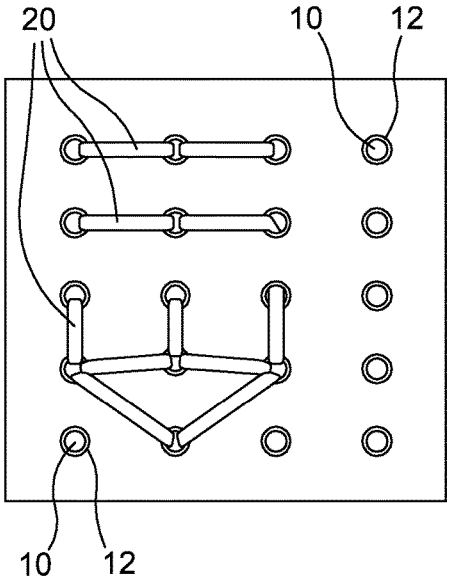
FIG. 1 is a plan view showing a matrix for letters and patterns on fabric according to an embodiment of the invention.
Figure 2:
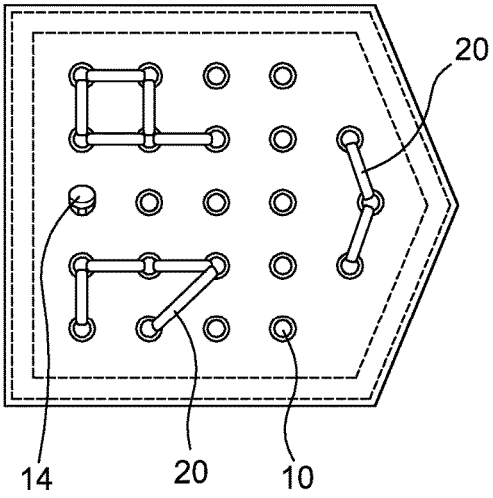
FIG. 2 is a plan view showing a matrix for letters and patterns on fabric according to another embodiment of the invention.
Figure 3:
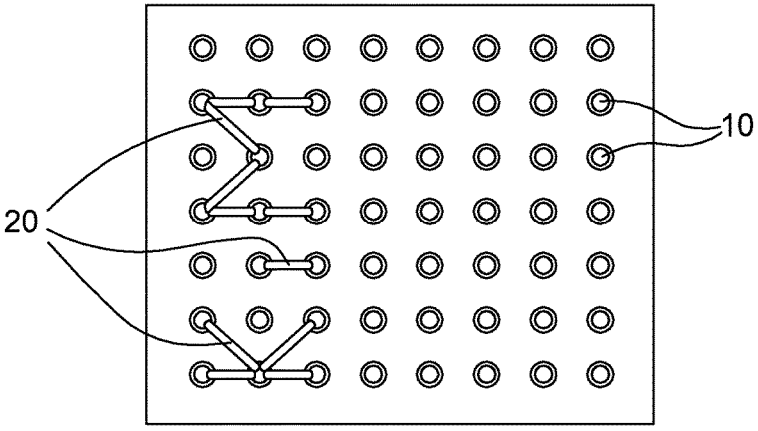
FIG. 3 is a plan view showing a matrix for letters and patterns on fabric according to still another embodiment of the invention.
Figure 4:
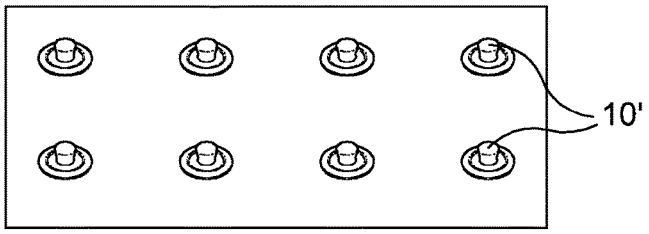
FIG. 4 is a plan view showing a matrix for letters and patterns on fabric according to still another embodiment of the invention.
Figure 5:
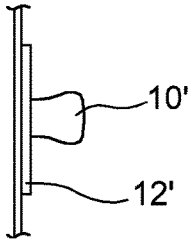
FIG. 5 is a side view of one of the thumbtack structures in FIG. 4.
Figure 6:
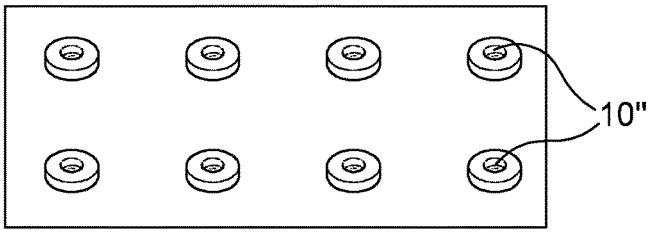
FIG. 6 is a plan view showing a matrix for letters and patterns on fabric according to still another embodiment of the invention.
Figure 7:
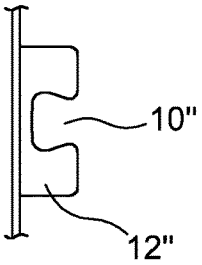
FIG. 7 is a side view of one of the thumbtack structures in FIG. 6.
Figure 8:
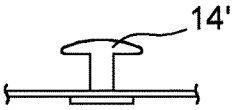
FIG. 8 is a side view showing a thumbtack structure in a matrix for letters and patterns on fabric according to still another embodiment of the invention.
Figure 9:
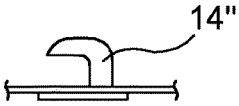
FIG. 9 is a side view showing a thumbtack structure in a matrix for letters and patterns on fabric according to still another embodiment of the invention.
Figure 10:
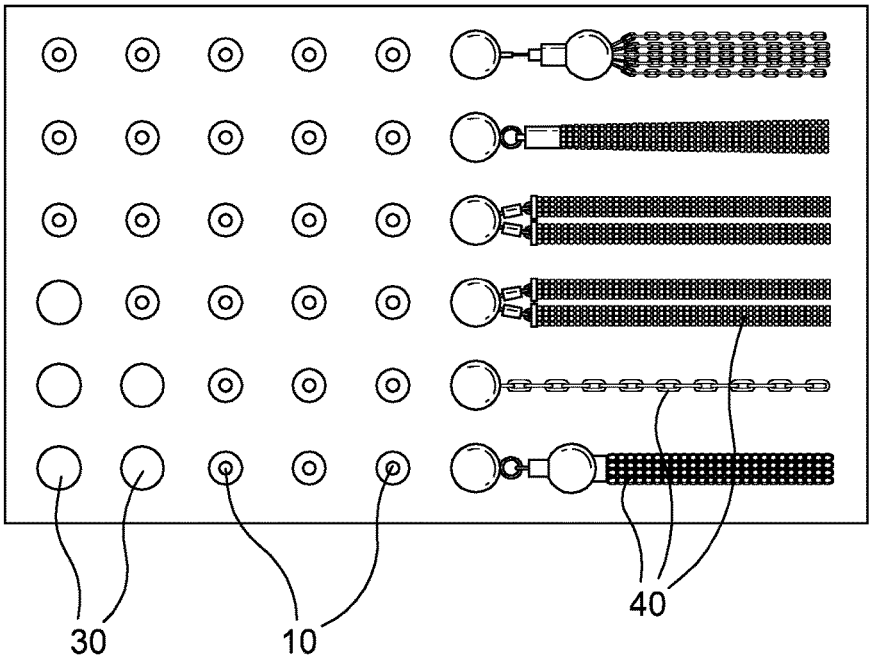
FIG. 10 is a plan view showing a matrix for letters and patterns on fabric along with decoration attachments according to still another embodiment of the invention.

FIGS. 1 to 3 show a matrix of holes and letters and patterns according to embodiments of the invention, FIGS. 4 and 5 show a matrix of protruding thumbtacks according to another embodiments of the invention, FIGS. 6 and 7 show a matrix of receding thumbtacks according to still another embodiments of the invention, FIGS. 8 and 9 show another types of hooks according to still another embodiments of the invention, and FIG. 10 shows decorating attachments hooked on a matrix of protruding thumbtacks according to still another embodiments of the invention.

FIG. 1 shows a matrix for letters and patterns on fabric according to an embodiment of the invention. The holes (10) are provided through the fabric (blue jean like base material in the figure). Furthermore, each hole (10) is enclosed by a edge portion (12), which may be made of metal as illustrated. However, the edge portion (12) can be made of any material as long as it can maintain the hole (10) within in the middle of the fabric. Now, the holes (10) can be made to knit letters or patterns with strings (20). Ready-made letters or patterns (not shown) in such style can be made to apply to the fabric.

FIG. 2 shows a matrix for letters and patterns on fabric according to another embodiment of the invention. A (10) may be installed with a hook (14) shown in the red box in the figure, which can be used to anchor another structures instead of the hole (10).

FIG. 3 shows a large matrix for letters and patterns on fabric according to still another embodiment of the invention, in which the holes (10) and the strings (20) knitted along some of the holes (10) can be used to form letters or patterns.

FIGS. 4 and 5 show a matrix for letters and patterns on fabric according to still another embodiment of the invention, in which protruding thumbtacks (10') are used for the holes (10) in other embodiments to form a matrix. The protruding thumbtacks (10') can be used to anchor or hold in place other materials to form letters or patterns.

FIGS. 6 and 7 show a matrix for letters and patterns on fabric according to still another embodiment of the invention, in which the receding thumbtacks (10") are used for the holes (10) in other embodiments to form a matrix. The receding thumbtacks (10") can be used to anchor or hold in place other materials to form letters or patterns.

FIG. 8 shows a thumbtack structure in a matrix for letters and patterns on fabric according to still another embodiment of the invention, in which another type of hook (14') can be disposed through the hole (10) as in FIG. 2.

FIG. 9 shows a thumbtack structure in a matrix for letters and patterns on fabric according to still another embodiment of the invention, in which still another type of hook (14") can be disposed through the hole (10) as in FIG. 2.

Still the hooks are not limited to the types of FIGS. 8A and 9 as discussed briefly in the above.

FIG. 10 shows a matrix for letters and patterns on fabric along with decoration attachments according to still another embodiment of the invention. As discussed in the above, the matrix of holes (10, 10', 10") or hooks (14, 14', 14") can be used to form letters and patterns or anchor the decoration attachments (30, 40), each of which including a corresponding fasteners for engaging the matrix of holes (10, 10', 10") or hooks (14, 14', 14") directly.

Using the above matrix of holes (10, 10', 10") or hooks (14, 14', 14"), the fabric or cloth can be decorated with letters, patterns, or decoration attachments as described in the figures.

Furthermore, the matrix may further comprise a lining or line clothes behind the matrix, so as to prevent a wearer's skin from being abraded by the matrix structure.

As shown in FIGS. 1-11, an aspect of the invention provides a matrix (100) for fabric (900), and the matrix (100) comprises a plurality of engaging portions (10, 10', 10") and one or more decorating portions (20).

The plurality of engaging portions (10, 10', 10") are disposed over a specific surface area of the fabric (900).

The one or more decorating portions (20) are installed at one or more of the plurality of engaging portions (10, 10', 10").

The one or more decorating portions (20) form letters or patterns on the specific surface area of the fabric (900) as shown in FIGS. 1-3, 10, and 11.

The plurality of engaging portions (10, 10', 10") may be aligned so as to form a lattice as shown in FIGS. 11-13.

Eyes of the lattice may be triangular, rectangular, or hexagonal as shown in FIGS. 11-13. Of course, the shapes are not limiting, but any shape can be adopted as long as it can be used as anchoring sites for the decorating portions (20).

Each of the plurality of engaging portions (10, 10', 10") may have a hole through the fabric as shown in FIG. 11, in which each circle may represent a hole (10) through the fabric (900).

The plurality of engaging portions (10, 10', 10") may comprise the edge portion or eyelets (12), each of which being fixed to the hole (10) at an external perimeter of the eyelet (12) as shown in FIG. 1.

Each of the one or more decorating portions (20) may comprise a string, and the string may be queued through or tied at some of the eyelets (12), so as to form the letter or pattern as shown in FIGS. 1-3 and 11.

Some of the eyelets (12) may have shape and color different from remaining eyelets, so as to facilitate to form the letter or pattern as shown in FIG. 14, in which the twelve eyelets (12A) connected by dashed line in the middle have larger sizes than the surrounding eyelets (12B). Instead, the twelve eyelets (12A) may have a color different from the surrounding eyelets (12B). Of course, different color and size can be applied at the same time.

Each of the plurality of engaging portions (10) may comprise a protruding thumbtack or a receding thumbtack (10', 10") as shown in FIGS. 4-7.

Each of the one or more decorating portions (20) comprises a counter-part (22) of the protruding or receding thumbtack (10', 10") to be attached detachably to the protruding or receding thumbtack (10', 10").

The each of the one or more decorating portions (20) may further comprise a displaying button-top (30) or hanging decoration (40), which is fixed to the counter-part (22) as shown in FIGS. 10 and 15-16.

Alternatively, each of the plurality of engaging portions (10) may comprise a hook (14).

Figure 17:
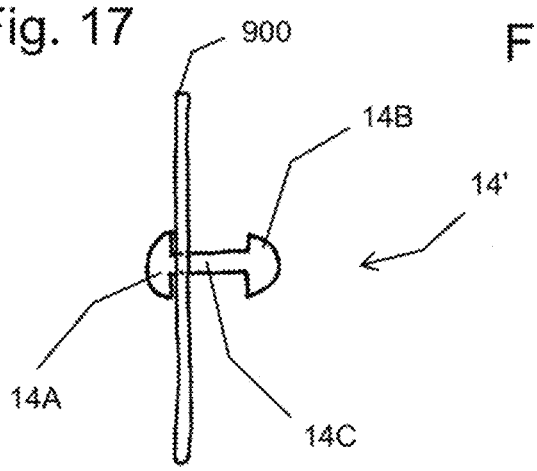
FIG. 17 is a side view showing a hook installed through fabric according to still another embodiment of the invention.
Figure 18:
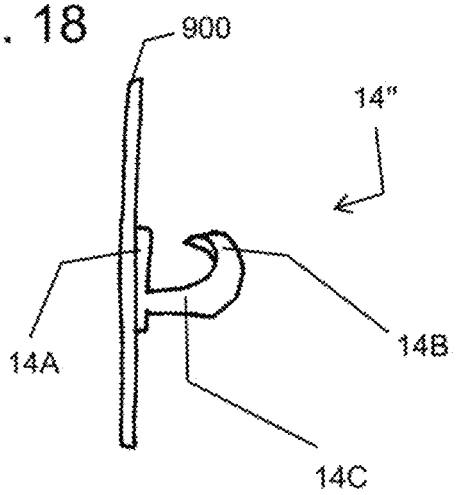
FIG. 18 is a side view showing another hook installed through fabric according to still another embodiment of the invention.

The hook (14) may comprise a fixing portion (14A) configured to fix the hook (14) to the fabric (900), a retaining portion (14B) configured to retain one of the one or more decorating portions (20), and a hooking portion (14C) provided between the fixing portion (14A) and the retaining portion (14B) and configured to hooking the one of the one or more decorating portions (20) as shown in FIGS. 10, 17, and 18.

Each of the fixing portion (14A) and the retaining portion (14B) may have a shape of disc and the hooking portion (14C) has a shape of cylinder, and the diameter of the hooking portion (14C) may be smaller than the diameter of the fixing portion (14A) and the retaining portion (14B) with the hooking portion (14C) penetrating the fabric (900) as shown in FIG. 17.

Alternatively, the hooking portion (14C) may extend substantially vertically from the fixing portion (14A) and the retaining portion (14B) may extend substantially horizontally from the hooking portion (14C), forming a retaining gap surrounded by the hooking portion (14C), the retaining portion (14B), and the fixing portion (14A) as shown in FIG. 18.

Figure 19:
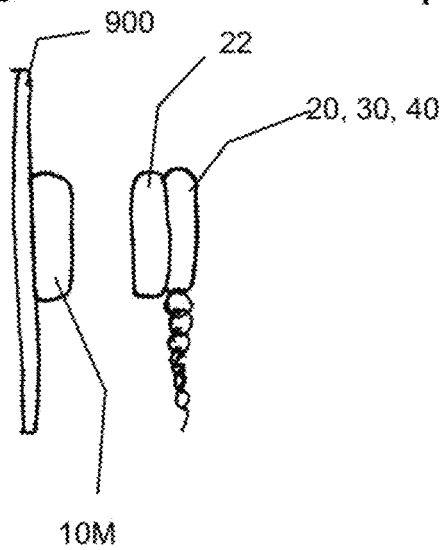
FIG. 19 is a side view of a engaging portion and a decorating portion with magnets according to still another embodiment of the invention.
Figure 20:
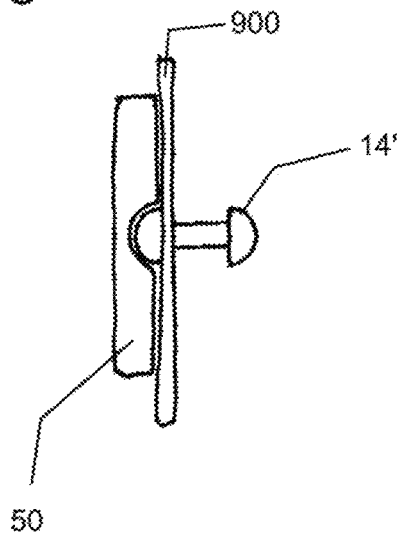
FIG. 20 is a a side cross-sectional view showing the matrix with line cloth attached from behind according to still another embodiment of the invention.

Alternatively, each of the plurality of engaging portions (10) may comprise magnet (10M), and each of the one or more decorating portions (20) may comprise material with magnetism as shown in FIG. 19.

One of the one or more decorating portions (20) may comprise a button (30) configured to be attached to one of the plurality of engaging portions (10, 10', 10"), and the button (30) may have a color, a letter, or a pattern as shown in FIG. 10.

One of the one or more decorating portions (20) may comprise chains or strings (40) as shown in FIG. 10.

The matrix (100) may further comprise a lining or line clothes (50) on the fabric (900) behind the matrix (100), preventing a wearer's skin from being abraded by the matrix (100).

While the invention has been shown and described with reference to different embodiments thereof, it will be appreciated by those skilled in the art that variations in form, detail, compositions and operation may be made without departing from the spirit and scope of the invention.

What is claimed is:

1. A matrix for fabric, the matrix comprising:

a plurality of engaging portions disposed over a specific surface area of the fabric, wherein the plurality of engaging portions are aligned so as to form a lattice and each of the plurality of engaging portions has a hole through the fabric, one or more decorating portions installed at one or more of the plurality of engaging portions, wherein the plurality of engaging portions comprise eyelets, each of which being fixed to the hole at an external perimeter of the eyelet, and wherein the one or more decorating portions form a letter or a pattern on the specific surface area of the fabric.

2. The matrix for fabric of claim 1, wherein each of the one or more decorating portions comprises a string, and wherein the string is queued through or tied at some of the eyelets, so as to form the letter or pattern.

3. The matrix for fabric of claim 2, wherein some of the eyelets have shape and color different from remaining eyelets, so as to facilitate to form the letter or pattern.

4. A matrix for fabric, the matrix comprising:

a plurality of engaging portions disposed over a specific surface area of the fabric, wherein the plurality of engaging portions are aligned so as to form a lattice and each of the plurality of engaging portions has a hole through the fabric, one or more decorating portions installed at one or more of the plurality of engaging portions, wherein the plurality of engaging portions comprise eyelets, each of which being fixed to the hole at an external perimeter of the eyelet, wherein the one or more decorating portions form a letter or a pattern on the specific surface area of the fabric and wherein eyes of the lattice are triangular, rectangular, or hexagonal.

5. The matrix for fabric of claim 4, wherein each of the one or more decorating portions comprises a string, and wherein the string is queued through or tied at some of the eyelets, so as to form the letter or pattern.

6. The matrix for fabric of claim 4, wherein some of the eyelets have shape and color different from remaining eyelets, so as to facilitate to form the letter or pattern.

* * * * *